US006894675B2

(12) United States Patent
Bruning et al.

(10) Patent No.: US 6,894,675 B2
(45) Date of Patent: May 17, 2005

(54) SEAMLESS HIGHLIGHTING IN LCD MONITORS AND LCD-TV

(75) Inventors: Gert W. Bruning, Sleepy Hollow, NY (US); Chin Chang, Yorktown Heights, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 198 days.

(21) Appl. No.: 10/055,351

(22) Filed: Jan. 22, 2002

(65) Prior Publication Data

US 2003/0137484 A1 Jul. 24, 2003

(51) Int. Cl.[7] ..... G09G 3/36

(52) U.S. Cl. ..... 345/102; 345/211; 345/77; 349/61

(58) Field of Search ..... 345/102, 211, 345/77, 690; 315/224; 349/61

(56) References Cited

U.S. PATENT DOCUMENTS 4,733,229 A * 3/1988 Whitehead ..... 345/20
5,734,362 A * 3/1998 Eglit ..... 345/89
5,808,597 A * 9/1998 Onitsuka et al. ..... 345/102
5,907,742 A * 5/1999 Johnson et al. ..... 399/51
6,151,008 A 11/2000 Zhang ..... 345/102
6,184,861 B1 * 2/2001 Callway ..... 345/690
6,313,586 B1 * 11/2001 Yamamoto et al. ..... 315/224
6,496,236 B1 * 12/2002 Cole et al. ..... 349/61
6,693,619 B1 * 2/2004 Miura et al. ..... 345/102
2001/0013854 A1 * 8/2001 Orogo
2002/0097210 A1 7/2002 Lonoce et al. ..... 345/87

FOREIGN PATENT DOCUMENTS

JP 2000-214838 * 8/2000 ..... G09G/5/10

* cited by examiner

*Primary Examiner*—Regina Liang
*Assistant Examiner*—Jennifer T. Nguyen

(57) ABSTRACT

The liquid crystal display panel of the present invention provides rapid highlighting of the display. To provide highlighting, current to the backlighting lamp is increased from a normal current to a highlighting current. During the transition from the normal current to the highlighting current, the current to backlighting lamp is increased to an intermediate current above the highlighting current, and then decreased to the highlighting current. The increase to an intermediate current provides greater energy to the backlighting lamp than a direct increase from the low current to the highlighting current. The increased energy heats the backlighting lamp quickly to provide the increased light for highlighting. In addition, reducing the current to the backlighting lamp below the normal current when leaving the highlighting mode decreases the time to leave the highlighting mode.

25 Claims, 4 Drawing Sheets

SEAMLESS HIGHLIGHTING IN LCD MONITORS AND LCD-TV

TECHNICAL FIELD

The technical field of this disclosure is liquid crystal display panels, particularly, a liquid crystal display panel providing rapid highlighting.

BACKGROUND OF THE INVENTION

Liquid crystal display (LCD) panels have developed as an alternative to cathode ray tubes (CRTs), offering the advantage of a thin profile and brilliant display. LCD panels have been used for a number of applications, including computer monitors and television displays.

One highly desirable feature for displays is the ability to highlight a portion of a display at a brighter intensity for easier viewing. For example, a computer user may wish to use a cursor to delineate a portion of a picture on a display and brighten that portion for easier viewing. In another example, a computer or television user may want to view one program in the main display and another program in an inset window. The two programs may require different amounts of lighting: a simple, high contrast subject such as text can be easily seen, but a complex subject such as video may require brighter intensity lighting. Highlighting the complex subject makes it easier to see.

LCD panels have lagged CRTs in highlighting functionality. LCD panels typically use one or two fluorescent lamps, such as a mercury vapor cold cathode fluorescent lamps (CCFLs), to provide a uniform backlighting of the LCD panel. CRTs are able to quickly highlight a portion of the display by increasing beam energy, while LCD panel highlighting lags due to the time required to increase the backlight lamp temperature. Individual liquid crystal (LC) elements control the brightness of specific areas of the LCD panel. The lamps must be at the full brightness level before the LC elements can provide the proper highlighting.

For the present generation of LCD panels possessing a highlighting function, the lamps normally operate at 50% lamp current and light output during conditions of non-highlighting. The lamp is stepped to 100% lamp current when highlighting is required. Because of the thermal lag in the lamp, there is visible delay of 10 to 20 seconds before the lamp reaches 100% light output. This is undesirable, as the user must wait for the highlighting to appear. The user may even think that the delay indicates a problem with the display or the computer.

FIG. 1 shows a graph of a step increase in lamp current and the delay in lamp light output. The lamp current is initially 50% and the lamp light output is initially 50%. When the user requests highlighting, the lamp current is increased to 100% and the light output gradually increases from 50% to 100% over 10 to 20 seconds. The user must wait the 10 to 20 seconds before the highlighting is effective.

It would be desirable to have a liquid crystal display panel providing rapid highlighting that would overcome the above disadvantages.

SUMMARY OF THE INVENTION

One aspect of the present invention provides a liquid crystal display panel providing rapid highlighting without a substantial delay.

Another aspect of the present invention provides a liquid crystal display panel providing rapid highlighting that reduces the user waiting time.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

DESCRIPTION OF THE PREFERRED EMBODIMENT

The liquid crystal display panel of the present invention provides rapid highlighting of the display. To provide highlighting, current to the backlighting lamp is increased from a normal current to a highlighting current. During the transition from the normal current to the highlighting current, the current to backlighting lamp is increased to an intermediate current above the highlighting current, and then decreased to the highlighting current. The increase to an intermediate current provides greater energy to the backlighting lamp than a direct increase from the low current to the highlighting current. The increased energy heats the backlighting lamp quickly to provide the increased light for highlighting. In addition, reducing the current to the backlighting lamp below the normal current when leaving the highlighting mode decreases the time to leave the highlighting mode.

Figure 1:
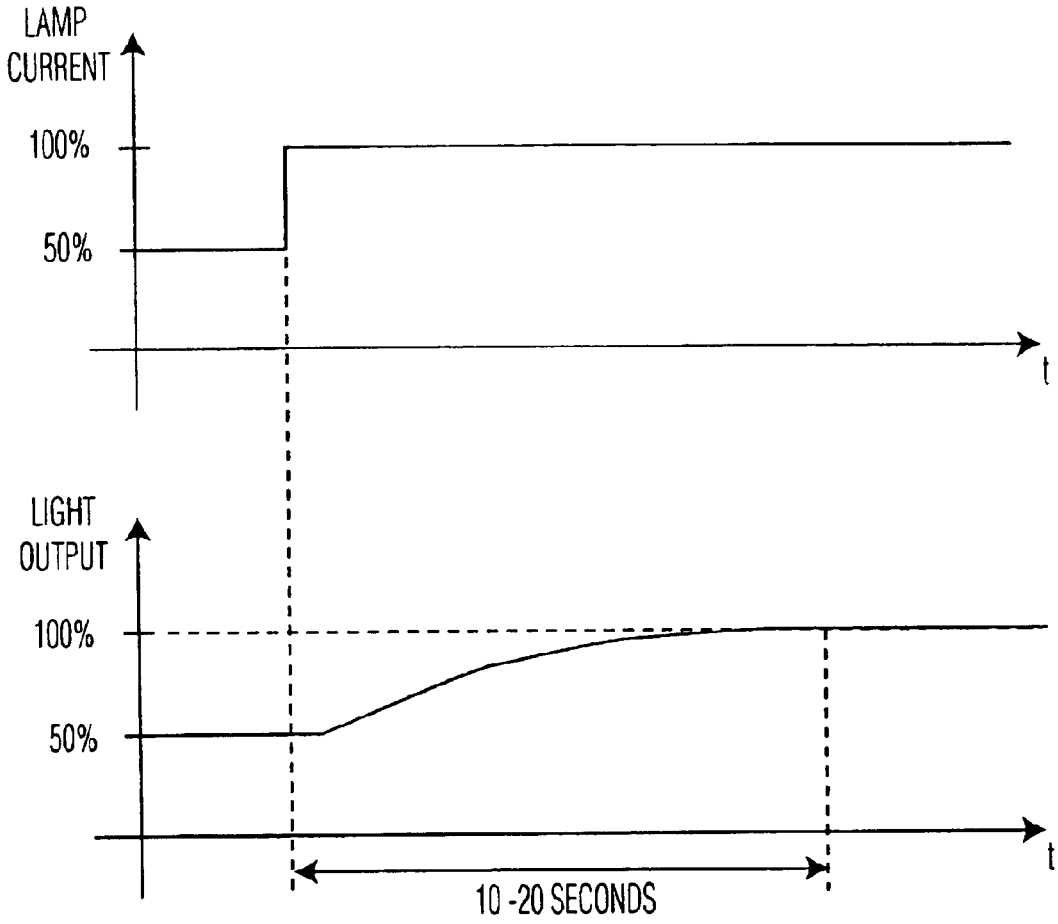
FIG. 1 shows a graph of a step increase in lamp current and the delay in lamp light output.
Figure 2:
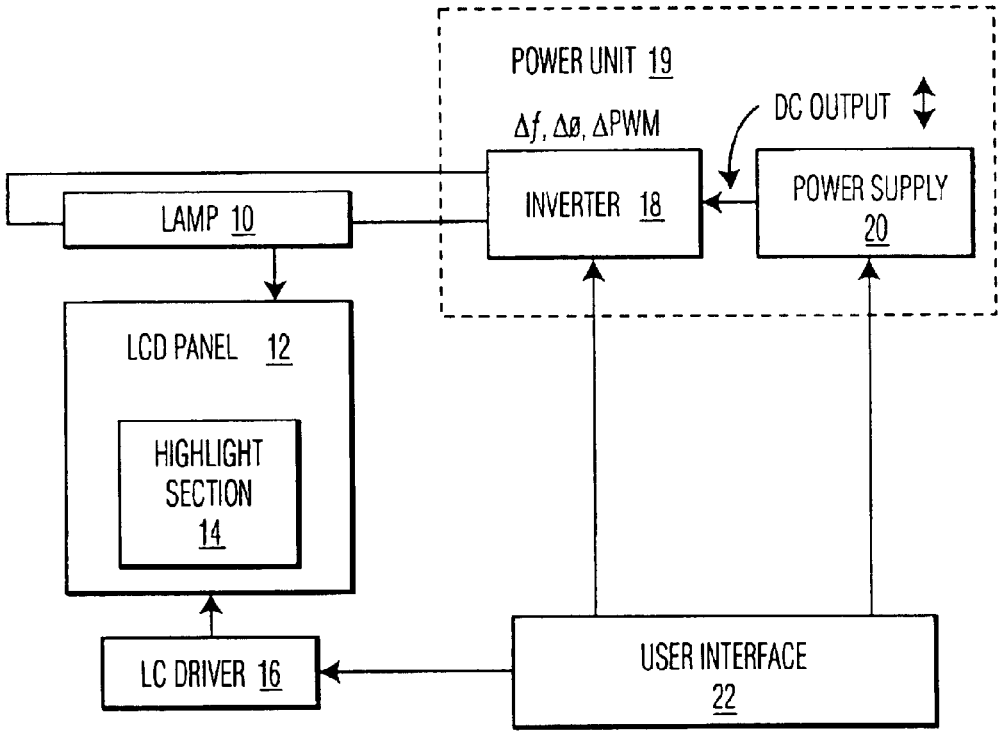
FIG. 2 shows a block diagram of a liquid crystal display panel system made in accordance with the present invention.

FIG. 2 shows a block diagram of a liquid crystal display panel system made in accordance with the present invention. Liquid crystal display (LCD) panel 12 having a highlight section 14 is backlit by lamp 10. Liquid crystal (LC) driver 16 controls the liquid crystal array of the LCD panel 12. Power supply 20 supplies DC power to inverter 18, which provides current to the lamp 10. User interface 22 controls the LC driver 16, the inverter 18, and the power supply 20.

Liquid crystal display (LCD) panel 12 can be a conventional LCD panel comprising an array of pixels. The pixels further comprise liquid crystal shutters to adjust brightness from each particular pixel, and can have color filters to provide a color display. The liquid crystal shutters are controlled by the LC driver 16. The liquid crystal shutters of the highlight section 14 are more open than the liquid crystal shutters in the rest of the LCD panel 12 to provide the additional brightness required for highlighting.

Lamp 10 provides backlighting for the LCD panel 12 so that the light is transmitted through the pixels to the user. Typically, the lamp 10 can be one or more fluorescent lamps, such as mercury vapor cold cathode fluorescent lamps (CCFLs). The lamp 10 can also be provided with a light guide to direct the light and assure uniform backlighting behind the LCD panel 12. The lamp 10 typically operates at a low power level, such as 50% light output, during normal operation and at a high power level, such as 100% light output, when highlighting is requested by the user. The highlight section 14 can be formed with the lamp 10 operating at the high power level and the LC driver 16 opening the shutters for the pixels in the highlight section 14. In one embodiment, the highlight section 14 can cover the whole display of the LCD panel 12.

Power unit 19 comprises power supply 20 and inverter 18, and provides the power to the lamp 10. The power supply 20 produces a DC output voltage to feed the inverter 18, which produces an AC output for the lamp 10. The power supply 20 and inverter 18 can be used separately or in combination control the current to the lamp 10. The power supply 20 can adjust the DC output voltage to the inverter 18 to provide the desired amount of current to the lamp 10. The inverter 18 can adjust the frequency, phase, pulse width modulation, or a combination of these parameters, to adjust the current to the lamp 10. The power supply 20 and inverter 18 are commercially available and are well known to those skilled in the art.

User interface 22 accepts the highlighting request from the user and coordinates the highlighting of the LCD panel 12. The user interface 22 can be a controller, such as a computer or a microprocessor. The user interface 22 can be a single component or be distributed among several components. The user interface 22 directs a control signal to one or both of the inverter 18 and the power supply 20 to provide the proper current to the lamp 10. The user interface 22 also directs the LC driver 16 through highlight area control signals to adjust the liquid crystal shutters of LCD panel 12 to provide highlighted and non-highlighted regions, as desired by the user. Transitions to and from the highlighted mode, including intermediate currents to the lamp 10, are also controlled by the user interface 22 through intermediate control signals to the inverter 18 and the power supply 20.

Figure 3:
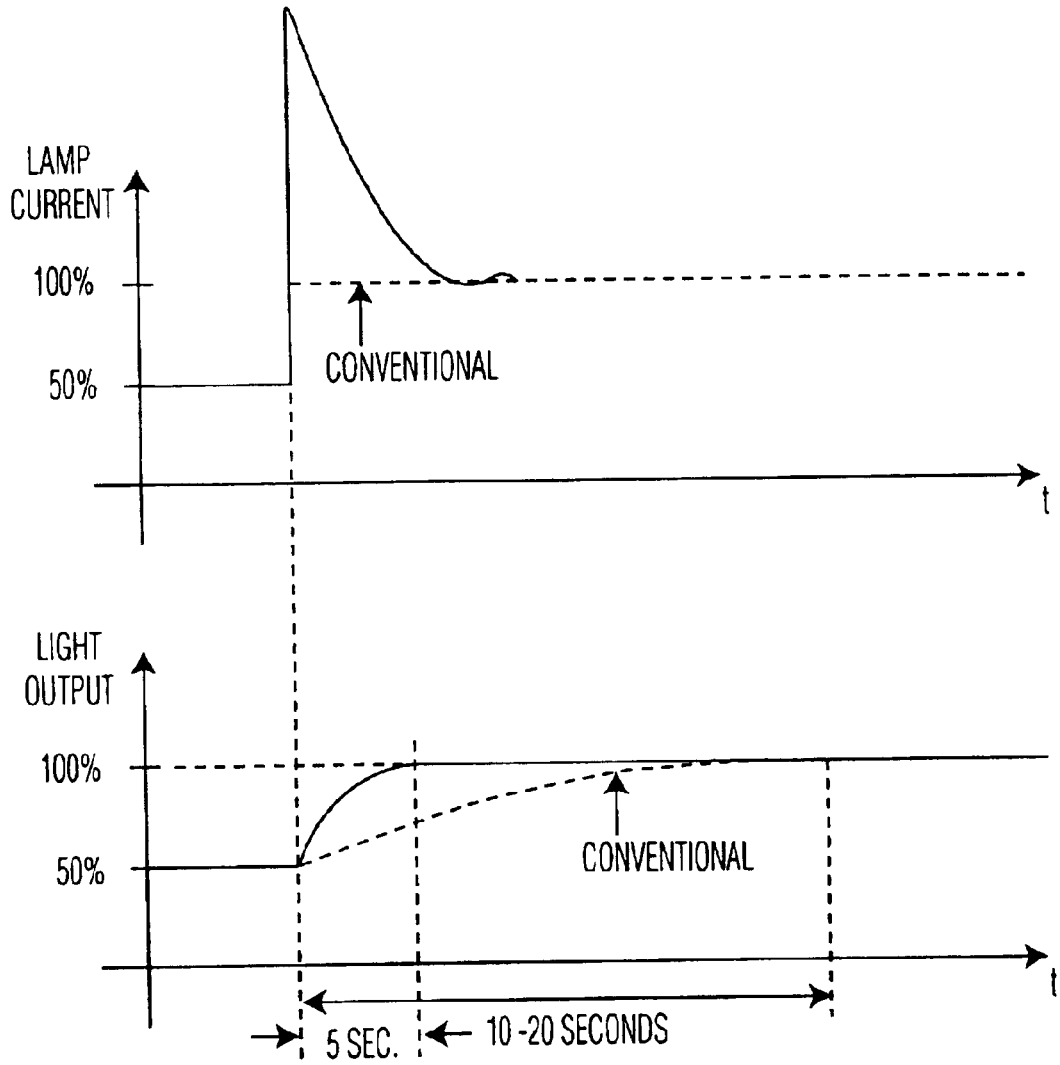
FIG. 3 shows a graph of lamp current and light output for a liquid crystal display panel applying an intermediate current made in accordance with the present invention.

FIG. 3 shows a graph of lamp current and light output for a liquid crystal display panel applying an intermediate current. The lamp current is initially at the low current of 50% and the lamp light output is initially 50%. When the user requests highlighting at the user interface, the user interface directs the inverter and/or power supply to increase lamp current to an intermediate current above the highlighting current of 100% then to decrease lamp current to the highlighting current of 100%. In this embodiment, the intermediate current is a step to a peak value with a decrease from the peak value as an exponential decay such as an RC (resistor-capacitor) circuit can produce. The light output of the lamp increases rapidly from 50% to 100% over about 5 seconds, at which time the highlighting is effective. On receiving the highlighting request, the user interface also directs the LC driver to adjust the liquid crystal shutters to form the highlighted section. The dashed lines illustrate the 10 to 20 second highlighting delay associated with a conventional LCD panel system, where the current is increased directly from the low current to the highlighting current.

Lamp characteristics determine how quickly highlighting can be achieved. While it is desirable to provide as much current to the lamp as possible to maximize heating and minimize time to achieve highlighting, too great a current can damage the lamp electrodes. The magnitude of the peak value and the current as a function of time consistent with preservation of lamp lifetime can be determined through experiment or calculation. In other embodiments with light output feedback, the magnitude of the peak value and the current as a function of time can be controlled by a feedback loop which attempts to obtain the desired light level as quickly as possible.

Figure 4:
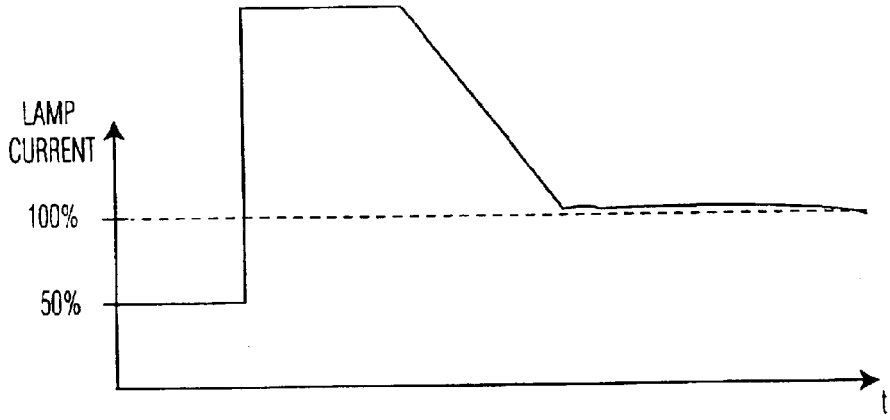
FIG. 4 shows a graph of lamp current for an alternate embodiment of a liquid crystal display panel applying an intermediate current made in accordance with the present invention.
Figure 5:
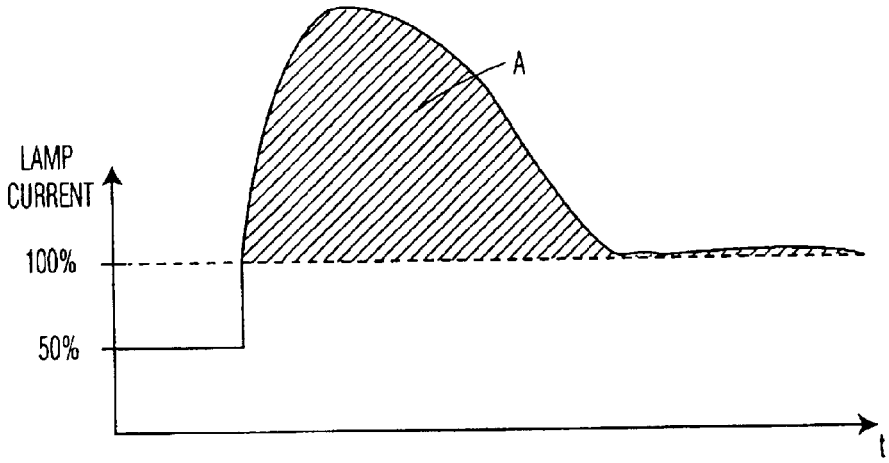
FIG. 5 shows a graph of lamp current for yet another alternate embodiment of a liquid crystal display panel applying an intermediate current made in accordance with the present invention.

FIGS. 4 and 5 show graphs of lamp current for alternate embodiments applying alternate intermediate currents. Referring to FIG. 4, the lamp current is initially at the low current of 50%. When the user requests highlighting at the user interface, the user interface directs the inverter and/or power supply to increase lamp current to an intermediate current above the highlighting current of 100%, hold the lamp current at the peak value for a predetermined time, then to decrease lamp current substantially linearly to the highlighting current of 100%. Referring to FIG. 5, the lamp current is initially at the low current of 50%. When the user requests highlighting at the user interface, the user interface directs the inverter and/or power supply to increase lamp current to a peak value above the highlighting current of 100% along a predetermined curve and then to decrease lamp current along the predetermined curve to the highlighting current of 100%. The curve can be determined to maximize the area A under the curve within the constraint of electrode current handling capability, i.e., avoiding severe electrode sputtering. This approach delivers the maximum energy to the lamp, providing the fastest warm-up and quickest highlighting.

Figure 6:
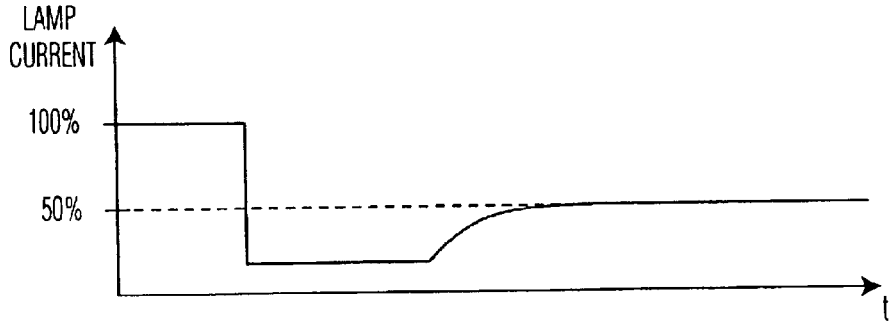
FIG. 6 shows a graph of lamp current for yet another alternate embodiment of a liquid crystal display panel applying an alternate intermediate current to leave the highlighting mode made in accordance with the present invention.

FIG. 6 shows a graph of lamp current for an alternate embodiment applying an alternate intermediate current to leave the highlighting mode. The above discussion of going from the normal mode to the highlighting mode, i.e., going from 50% to 100% lamp current, applies equally to going from the highlighting mode to the normal mode, i.e., going from 100% to 50% lamp current. Taking the lamp current to an intermediate value less than the target low current of 50% can achieve the normal mode more quickly than taking the lamp current directly to the 50% value.

Referring to FIG. 6, the lamp current is initially at the highlighting current of 100% so that the lamp light output would be 100% in the highlighting mode. When the user requests termination of highlighting at the user interface, the user interface directs the inverter and/or power supply to decrease lamp current to an intermediate current below the low current of 50%, hold the lamp current at the minimum value for a predetermined time, then increase lamp current to the low current of 50%. The light output of the lamp decreases rapidly from 100% to 50%, at which time the highlighting ends. On receiving the highlighting termination request, the user interface also directs the LC driver to adjust the liquid crystal shutters to remove the highlighted section.

It is important to note that FIGS. 2–6 illustrate specific applications and embodiments of the present invention, and are not intended to limit the scope of the present disclosure or claims to that which is presented therein. For example, numerous variations in the shape and magnitude of the lamp current versus time curve can be used to good effect. Lamp current can be varied by changing voltage, frequency, phase, or pulse width modulation, alone or in combination. The low and highlighting lamp current can be selected as values other than 50% and 100% and in different ratios than 1:2. Upon reading the specification and reviewing the drawings hereof, it will become immediately obvious to those skilled in the art that myriad other embodiments of the present invention are possible, and that such embodiments are contemplated and fall within the scope of the presently claimed invention.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A liquid crystal display panel system responsive to a highlighting request, the liquid crystal display panel system comprising:

a lamp providing lighting to the liquid crystal display panel, the lamp having a normal mode and a highlighting mode;

a power unit operatively coupled to the lamp, the power unit providing current to the lamp, the power unit being responsive to a control signal; and a user interface operatively coupled to the power unit, the user interface providing the control signal to the power unit, wherein the user interface provides an intermediate control signal in response to the highlighting request, the intermediate control signal causing the power unit to increase the current to the lamp from a normal mode current to an intermediate current above a highlighting mode current, then to decrease the current from the intermediate current to the highlighting mode current.

2. The system of claim 1, wherein the intermediate control signal causes the power unit to increase the current to the lamp from the normal mode current to an intermediate current above the highlighting mode current in a step change, then to decrease the current to the lamp exponentially from the intermediate current to the highlighting mode current.

3. The system of claim 1, wherein the intermediate control signal causes the power unit to increase the current to the lamp from the normal mode current to an intermediate current above the highlighting mode current in a step change, to hold the intermediate current for a predetermined time, then to decrease the current to the lamp linearly from the intermediate current to the highlighting mode current.

4. The system of claim 1, wherein an integrated area under an intermediate current-time curve is maximized for at least one characteristic of the lamp.

5. The system of claim 1, wherein the power unit includes a power supply supplying DC output voltage to an inverter, the inverter providing current to the lamp.

6. The system of claim 5, wherein the power supply controls the current to lamp by varying the DC output voltage in response to the control signal.

7. The system of claim 5, wherein, in response to the control signal, the inverter controls the current to lamp by varying a current parameter selected from a group including a frequency of the current, a phase of the current, a pulse width modulation of the current, and any combination thereof.

8. The system of claim 1, further comprising:

an LC driver responsive to a highlight area control signal from the user interface, wherein the liquid crystal display panel has a highlight section, and wherein the LC driver controls lighting of the highlight section of the liquid crystal display panel.

9. The system of claim 1, further comprising:

a lamp output sensor monitoring a light output of the lamp and providing a lamp output feedback signal, the lamp output feedback signal controlling the intermediate control signal.

10. A liquid crystal display panel system responsive to a highlighting request, the liquid crystal display panel system comprising:

means for lighting the liquid crystal display panel, the lighting means having a normal mode and a highlighting mode;

means for supplying current to the lighting means, the current supplying means being responsive to a control signal; and means for interfacing with a user, the user interfacing means providing the control signal to the current supplying means, wherein the user interfacing means provides an intermediate control signal in response to the highlighting request, the intermediate control signal causing the current supplying means to increase the current to the lighting means from a normal mode current to an intermediate current above a highlighting mode current, then to decrease the current from the intermediate current to the highlighting mode current.

11. The system of claim 10, wherein the intermediate control signal causes the current supplying means to increase the current to the lighting means from the normal mode current to an intermediate current above the highlighting mode current in a step change, then to decrease the current to the lighting means exponentially from the intermediate current to the highlighting mode current.

12. The system of claim 10, wherein the intermediate control signal causes the current supplying means to increase the current to the lighting means from the normal mode current to an intermediate current above the highlighting mode current in a step change, to hold the intermediate current for a predetermined time, then to decrease the current to the lighting means linearly from the intermediate current to the highlighting mode current.

13. The system of claim 10, wherein an integrated area under an intermediate current-time curve is maximized for at least one characteristic of the lighting means.

14. The system of claim 10, further comprising:

means for inverting DC to AC and providing current to the lighting means, wherein the current supplying means supplies a DC output voltage to the DC to AC inverting.

15. The system of claim 14, wherein the DC output voltage supplying means controls the current to the lighting means by varying the DC output voltage in response to the control signal.

16. The system of claim 14, wherein, in response to the control signal, the DC to AC inverting means controls the current to the lighting means by varying a current parameter selected from a group including a frequency of the current, a phase of the current, a pulse width modulation of the current, and any combination thereof.

17. The system of claim 10, further comprising:

means for driving LCs responsive to a highlight area control signal from the user interface, wherein the liquid crystal display panel has a highlight section, and wherein the LC driving means controls lighting of the highlight section of the liquid crystal display panel.

18. The system of claim 10, further comprising:

means for monitoring a light output of the lighting means and providing a lamp output feedback signal, the lamp output feedback signal controlling the intermediate control signal.

19. A method of highlighting a liquid crystal display panel in response to a highlighting request, the method comprising, providing a lamp for lighting the liquid crystal display panel, the lamp having a normal mode and a highlighting mode;

increasing current to the lamp from a normal mode current to an intermediate current above a highlighting mode current in response to the highlighting request; and decreasing the current from the intermediate current to the lamp to the highlighting mode current.

20. The method of claim 19, further comprising:

holding the current at the intermediate current to the lamp for a predetermined time.

21. The method of claim 19, wherein increasing current to the lamp from the normal mode current to the intermediate current includes increasing the current by an increase selected from a group including a step increase, a linear increase, and an exponential increase.

22. The method of claim 19, wherein decreasing the current from the intermediate current to the highlight mode current includes decreasing the current by a decrease selected from a group including a step decrease, a linear decrease, and an exponential decrease.

23. The method of claim 19, wherein an integrated area under an intermediate current-time curve from starting to increase current to the lamp from the normal mode current until finishing decreasing the intermediate current to the lamp to reach the highlighting mode current is maximized for at least one characteristic of the lamp.

24. The method of claim 19, further comprising:

monitoring a light output of the lamp to produce a lamp output feedback signal; and adjusting the intermediate current based on the lamp output feedback signal.

25. A liquid crystal display panel system responsive to a highlighting termination request, the liquid crystal display panel system comprising:

a lamp providing a lighting to the liquid crystal display panel, the lamp having a normal mode and a highlighting mode;

a power unit operatively coupled to the lamp, the power unit providing current to the lamp, the power unit being responsive to a control signal; and a user interface operatively coupled to the power unit, the user interface providing the control signal to the power unit;

wherein the user interface provides an intermediate control signal in response to the highlighting termination request, the intermediate control signal causing the power unit to decrease the current to the lamp from a highlighting mode current to an intermediate current below a normal mode current, then to increase the current from the intermediate current to the normal mode current.

* * * * *